US005556194A

United States Patent [19]

Natsume et al.

[11] Patent Number: 5,556,194

[45] Date of Patent: Sep. 17, 1996

[54] VEHICULAR LAMP HAVING GLITTERING APPEARANCE

[75] Inventors: Kazunori Natsume; Nobuhiro Taki, both of Shizuoka, Japan

[73] Assignee: Koito Manufacturing Co., Ltd., Tokyo, Japan

[21] Appl. No.: 360,960

[22] Filed: Dec. 21, 1994

[30] Foreign Application Priority Data

Dec. 21, 1993 [JP] Japan ..... 5-072917 U

[51] Int. Cl.[6] ..... F21M 3/00

[52] U.S. Cl. ..... 362/299; 362/61; 362/328; 362/346

[58] Field of Search ..... 362/338, 299, 362/61, 297, 346, 328; 357/742, 743

[56] References Cited

U.S. PATENT DOCUMENTS 3,222,516 12/1965 Miles ..... 362/338
4,332,438 6/1982 Green ..... 362/338
5,307,246 4/1994 Schmid et al. ..... 362/338

FOREIGN PATENT DOCUMENTS 657511 5/1929 France ..... 362/338
1472555 7/1969 Germany ..... 362/346

*Primary Examiner*—Denise L. Gromada
*Assistant Examiner*—Sara Sachie Raab
*Attorney, Agent, or Firm*—Sughrue, Mion, Zinn, Macpeak & Seas

[57] ABSTRACT

The front opening of a lamp space with a bulb disposed therein is covered with a lens. The lens is segmented into five sectional areas. Cylindrical steps of which the axes are vertically oriented are formed on the rear side of these sectional areas. These cylindrical steps are arrayed in a zig-zag fashion such that the cylindrical steps in adjacent sectional areas are shifted from each other approximately half the width of a single cylindrical step.

13 Claims, 4 Drawing Sheets

VEHICULAR LAMP HAVING GLITTERING APPEARANCE

BACKGROUND OF THE INVENTION

The present invention relates to a vehicular lamp, and, more particularly, the invention provides an outer lens for a vehicular lamp which causes the lamp to have a glittering appearance.

In a conventional vehicular lamp, fisheye steps are often formed on an outer lens of the lamp to diffuse vertically and horizontally the light passing therethrough.

The conventional vehicular lamp with fisheye steps formed uniformly over the entire surface looks flat as a whole and does not provide a good overall visual impression.

SUMMARY OF THE INVENTION

The present invention was made in view of the foregoing disadvantages accompanying the conventional vehicular lamp.

Accordingly, an object of the invention is to provide a vehicular lamp having an outer lens capable of causing the lamp to have a glittering appearance so as to obtain an improved overall visual impression.

The above object can be achieved by the provision of a vehicular lamp which, according to the present invention, includes an outer lens for covering a front opening of a lamp body, the outer lens being provided with a plurality of sectional areas each containing cylindrical steps, the axes of which are oriented in the same direction, the cylindrical steps being arrayed in a zig-zag fashion such that cylindrical steps in adjacent segmental areas are shifted from each other approximately half the width of a single cylindrical step.

In the identification lamp thus constructed, the lamp provides a glittering appearance. Specifically, when viewing the lamp from its front side, one sees a number of glittering focal lines due to the cylindrical steps that are horizontally shifted in the adjacent segmental areas.

DESCRIPTION OF THE PREFERRED EMBODIMENTS

Figure 1:
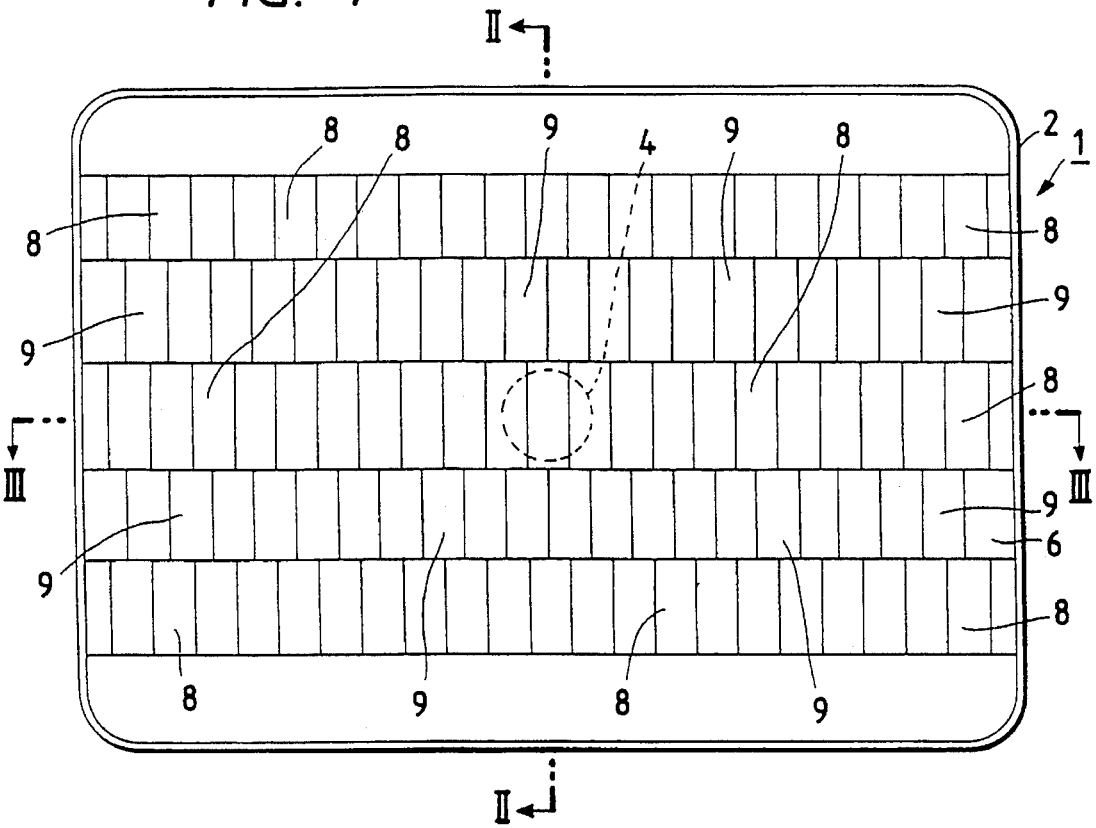
FIG. 1 is a front view showing a preferred embodiment of an identification lamp for a motor vehicle constructed according to the present invention.
Figure 2:
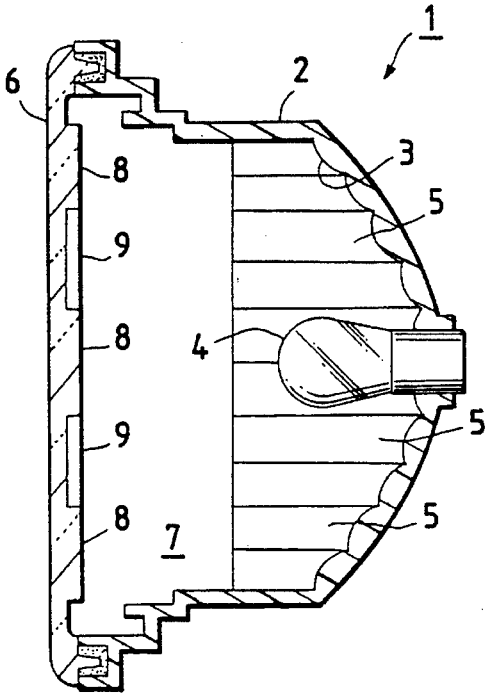
FIG. 2 is a cross-sectional view taken on a line II—II in FIG. 1.
Figure 3:
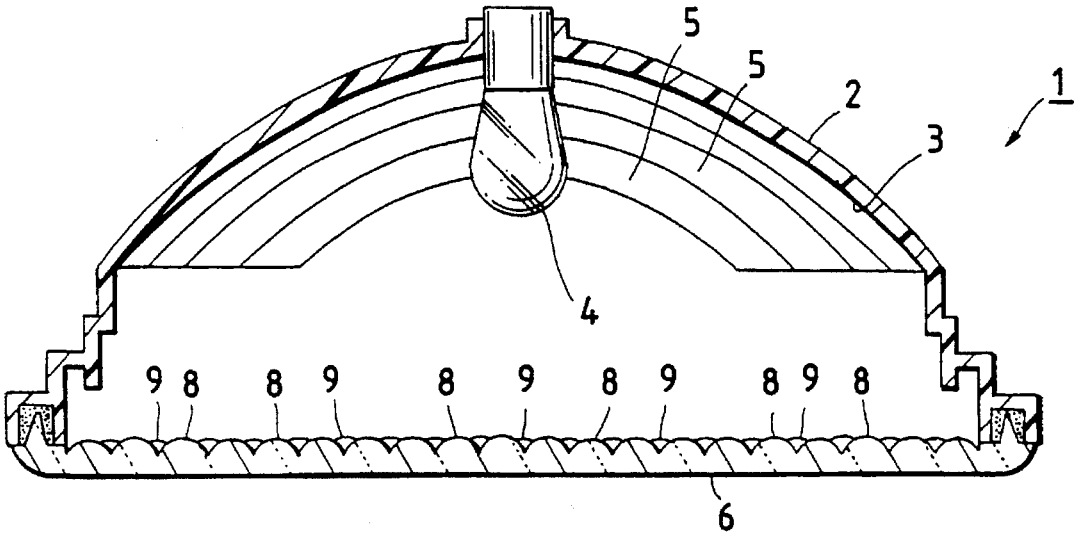
FIG. 3 is a cross-sectional view taken on a line III—III in FIG. 1.
Figure 4:
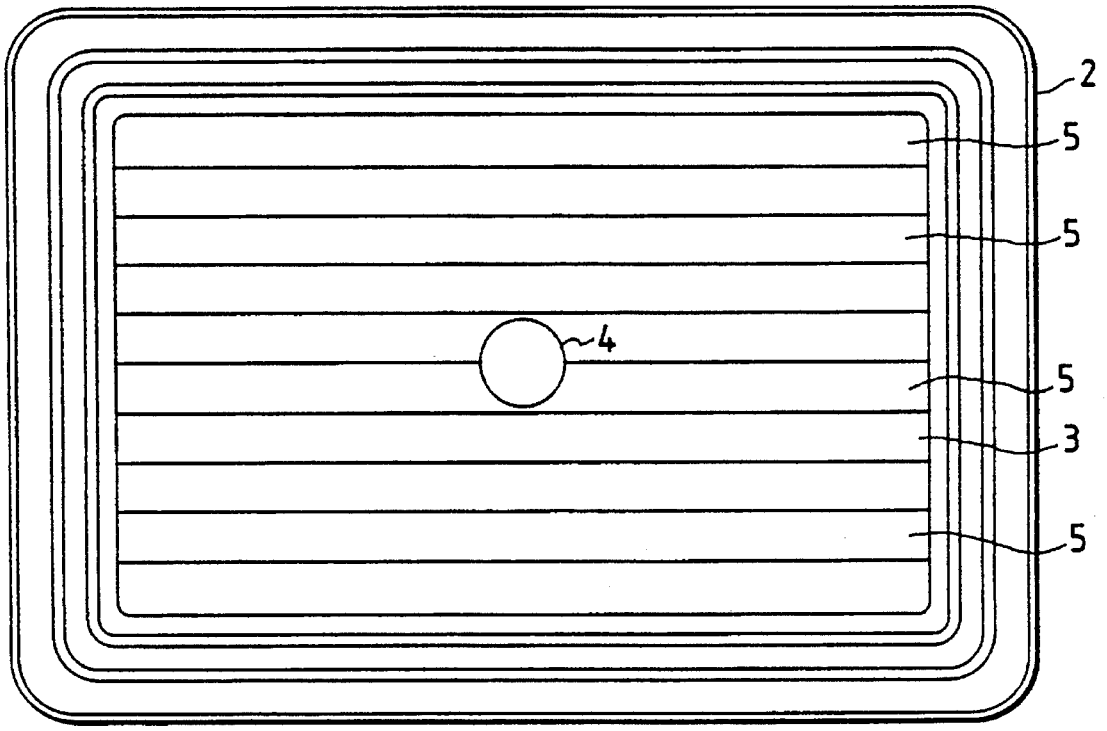
FIG. 4 is a front view showing a lamp body of the identification lamp of the present invention.

A preferred embodiment of a vehicular lamp constructed according to the present invention will be described in detail with reference to the accompanying drawings. In the embodiment described below, the present invention is applied to a marker lamp 1 for motor vehicles.

The marker lamp 1 is provided with a lamp body 2 made of a synthetic resin. The lamp body 2 is cup-shaped having a front opening. The inner surface 3 of the lamp body 2 serves as a reflector having a reflecting surface 3. A bulb 4 is disposed at a central part of the rear portion of the lamp body 2. Long narrow steps 5, each semicircularly and outwardly curved in cross section, are formed on the reflecting surface 3 in a state such that the long narrow steps are vertically arrayed. With provision of these long narrow steps 5, light beams from the bulb 4 are vertically diffused.

An outer lens 6 made of a transparent synthetic resin is attached to the lamp body 2 such that the front opening of the lamp body 2 is covered with the lens 6. A lamp space 7 is defined by the lamp body 2 and the lens 6.

The outer lens 6 is segmented into five sectional areas in the vertical direction of the lens, and cylindrical steps 8 and 9, the axes of which are vertically oriented, are formed on the rear side of these segmental areas on the outer lens 6. These cylindrical steps 8 and 9 are arrayed in a zig-zag fashion such that the cylindrical steps in the adjacent segmental areas are shifted from each other approximately half the width of a single cylindrical step.

With such a construction, the marker lamp 1 presents a glittering appearance. Specifically, when viewing the marker lamp from the front side thereof, one sees a number of glittering focal lines due to the cylindrical steps 8 and 9 in the adjacent segmental areas that are horizontally shifted.

The cylindrical steps 8 and 9 may be designed such that the radius of curvature of the cylindrical steps in one segmental area is different from that of the cylindrical steps in the adjacent segmental area, for example, the radius of curvature of the cylindrical step 8 may be larger than that of the cylindrical step 9. By so doing, when viewing the identification lamp, one sees the glittering reflecting surface 3 through the horizonal cylindrical steps 8, as well as the glittering vertical cylindrical steps 9. As a result, the marker lamp has an appearance of depth.

In the present embodiment, the long narrow steps 5 are formed on the reflecting surface 3 of the lamp body 2. These steps are formed to perform vertical diffusion of the light since the cylindrical steps 8 and 9 of the outer lens 6 are vertically arrayed, thereby horizontally diffusing the light. Therefore, the long narrow steps 5 formed on the reflecting surface 3 may be replaced with any other arrangement capable of diffusing light vertically.

Figure 5:
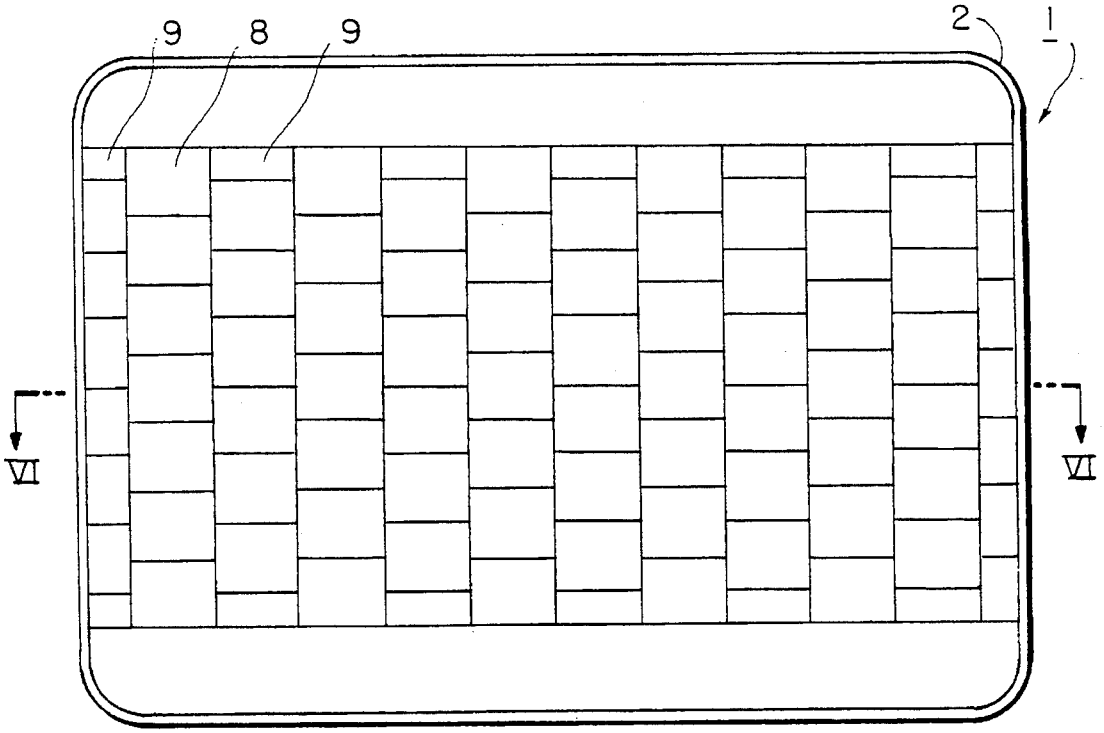
FIG. 5 is a front view showing an alternative embodiment of the lamp shown in FIG. 1.
Figure 6:
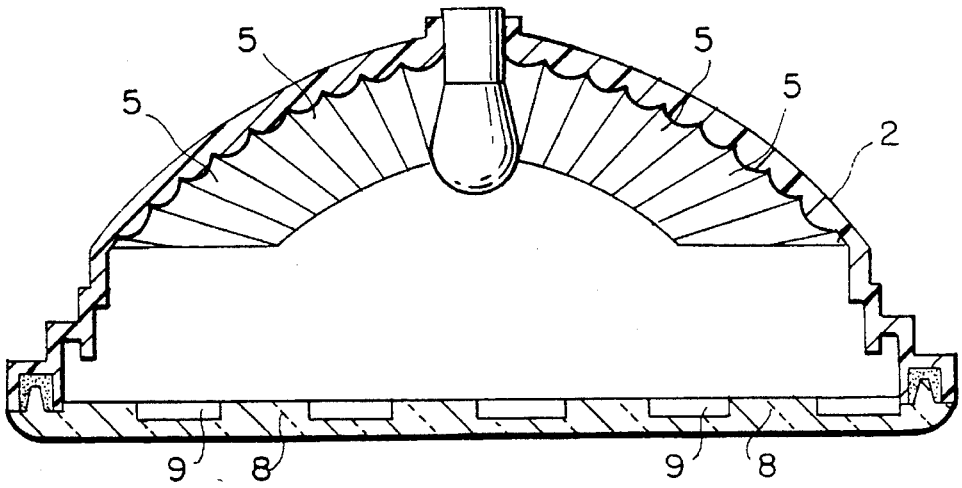
FIG. 6 is a cross-sectional view taken on a line VI—VI in FIG. 5.
Figure 7:
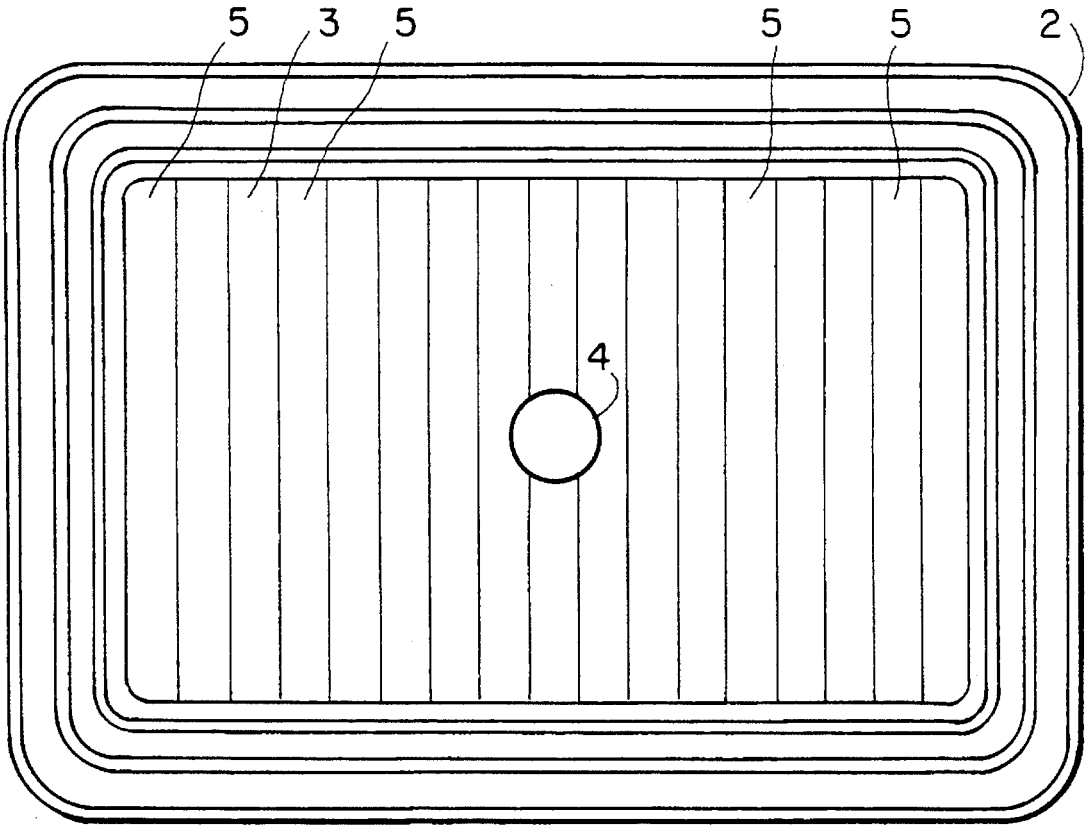
FIG. 7 is a front view of a lamp body of the alternative embodiment shown in FIGS. 5 and 6.

In a case where the cylindrical steps 8 and 9 formed on the outer lens 6 are horizontally extended to vertically diffuse the light (see FIG. 5), the light diffusing arrangement formed on the reflecting surface 3 must be capable of reflecting light beams while diffusing the light horizontally (see the vertically extending steps 5 in FIGS. 6 and 7).

As seen from the foregoing description, the inventive vehicular lamp includes an outer lens covering a front opening of a lamp body, the outer lens being provided with a plurality of sectional areas each composed of cylindrical steps, the axes of which are oriented in the same direction. The cylindrical steps are arrayed in a zig-zag fashion such that the cylindrical steps in adjacent segmental areas are shifted from each other approximately half the width of a single cylindrical step.

In the lamp thus constructed, the lamp presents generally a glittering appearance. Specifically, when viewing the lamp from its front side, one sees a number of glittering focal lines owing to the cylindrical steps 8 and 9 that are horizontally shifted in the adjacent segmental areas.

In the above-described embodiment, the axes of the cylindrical steps are vertically oriented. If required, these may be oriented horizontally. In the latter case, the outer lens is segmented in the horizontal direction. The number of segmental areas may also be selected as desired.

It should be understood that the form of the invention herein shown and described is to be taken as a preferred example of the invention and that various changes in the shape, size and arrangement of parts may be resorted to without departing from the spirit of the invention or the scope of the subjoined claims. Of course, the invention may be applied not only to marker lamps but also to turn-signal lamps, tail lamps or stop lamps if desired.

What is claimed is:

1. A vehicular lamp comprising:

a lamp body having a front opening and a reflector;

a light source mounted in said lamp body;

an outer lens covering said front opening of said lamp body, said outer lens having a plurality of sectional areas each having formed therein cylindrical steps diffusing light in a first direction, said cylindrical steps in adjacent sectional areas being shifted from each other; and means for diffusing light emitted from said light source, said diffusing means being disposed on said reflector of said lamp body, and said diffusion means diffusing light in a second direction substantially perpendicular to said first direction.

2. The vehicular lamp of claim 1, wherein axes of said cylindrical steps are vertically oriented, thereby diffusing light horizontally.

3. The vehicular lamp of claim 2, wherein said light diffusing means is horizontally oriented, thereby diffusing light vertically.

4. The vehicular lamp of claim 1, wherein axes of said cylindrical steps are horizontally oriented, thereby diffusing light vertically.

5. The vehicular lamp of claim 4, wherein said light diffusing means is vertically oriented, thereby diffusing light horizontally.

6. The vehicular lamp of claim 1, wherein said sectional areas of said outer lens are arrayed in a vertical direction of said outer lens.

7. The vehicular lamp of claim 6, wherein said outer lens has five sectional areas.

8. The vehicular lamp of claim 7, wherein a radius of curvature of each of said cylindrical steps in first, third and fifth sectional areas from a top thereof is larger than that in second and fourth sectional areas.

9. The vehicular lamp of claim 1, wherein said sectional areas of said outer lens are arrayed in a horizontal direction of said outer lens.

10. The vehicular lamp of claim 1, wherein said light diffusion means comprises a plurality of long narrow steps each semicircularly and outwardly curved in cross section.

11. The vehicular lamp of claim 1, wherein a radius of curvature of cylindrical steps in one sectional area is different from that of a cylindrical step in an adjacent sectional area.

12. A vehicular lamp as recited in claim 1, wherein said light source is mounted at a center portion of said lamp body.

13. A vehicular lamp as recited in claim 1, wherein said cylindrical steps in adjacent sectional areas are shifted from each other by approximately half a width of a single one of said cylindrical steps.

* * * * *